United States Patent [19]

Tsuge et al.

[11] Patent Number: 4,462,379

[45] Date of Patent: Jul. 31, 1984

[54] EXHAUST GAS RECIRCULATING APPARATUS OF A DIESEL ENGINE

[75] Inventors: Noboru Tsuge, Kariya; Masahiro Taguchi, Okazaki; Masanori Kato, Toyoake; Satosi Kuwakado, Aichi, all of Japan

[73] Assignee: Nippon Soken, Inc., Nishio, Japan

[21] Appl. No.: 420,941

[22] Filed: Sep. 21, 1982

[30] Foreign Application Priority Data

Oct. 29, 1981 [JP] Japan ..... 56-172099

[51] Int. Cl.[3] ..... F02M 25/06

[52] U.S. Cl. ..... 123/569; 60/278

[58] Field of Search ..... 60/278, 279; 123/569

[56] References Cited

U.S. PATENT DOCUMENTS 3,846,980 11/1974 DePalma ..... 60/279

4,345,572 8/1982 Suzuki et al. ..... 60/279

4,388,912 6/1983 Kimura et al. ..... 123/569

FOREIGN PATENT DOCUMENTS 2259946 12/1972 Fed. Rep. of Germany ..... 60/278

2443582 8/1980 France ..... 123/569

*Primary Examiner*—Wendell E. Burns

*Attorney, Agent, or Firm*—Cushman, Darby & Cushman

[57] ABSTRACT

An EGR apparatus of a diesel engine having a particulate trapper means for preventing the particulate matter included in the exhaust gas from entering the engine cylinders.

The EGR apparatus has two valve means, one disposed in the EGR passage for controlling the flow of the recirculated gas, the other being disposed in the intake passage for throttling the fresh air. When the engine is in an idle condition, one valve is opened and the other valve is closed, thereby improving the performance of the engine in the idle condition.

9 Claims, 3 Drawing Figures

EXHAUST GAS RECIRCULATING APPARATUS OF A DIESEL ENGINE

FIELD AND BACKGROUND OF THE INVENTION

The present invention relates to an exhaust gas recirculating apparatus of a diesel engine.

Conventional exhaust gas recirculating (EGR) apparatuses of engines, especially diesel engine, are generally arranged to introduce a portion of the exhaust gas from an exhaust passage into an intake passage through an EGR passage having a flow control valve. The introduced exhaust gas is not purified and generally includes unburnt particulate matter, such as hydrocarbons, which is also introduced into the intake passages through the EGR passage. This particulate matter tends to deposit on pistons, valves, or the like. This causes excessive wear engine and shortened engine life. Further, in diesel engines, more air than needed tends to be sucked in at low speeds. This results in increased fuel consumption, formation of toxic components in the exhaust gas, and greater noise.

SUMMARY OF THE INVENTION

It is an object of the invention to solve the above-mentioned problems and to provide an exhaust gas recirculating apparatus of a diesel engine reducing the particulate matter passing through the EGR passage and improving combustion at low engine speeds so that formation of the toxic components and noise are reduced.

The present invention provides for an exhaust gas recirculating apparatus of a diesel engine having an intake air passage and an exhaust gas passage. The apparatus comprises a bypass passage having an inlet and an outlet to allow a portion of the exhaust gas to recirculate from the exhaust gas passage into the intake air passage, a normally closed first valve means in the bypass passage, a normally open second valve means in the intake passage on the upstream side of the outlet of the bypass passage, a means for trapping the particulate matter included in the exhaust gas, the trapper means being disposed so that the recirculating gas can pass through it, a means for detecting the idle condition of the engine, and an actuating means responsive to the output of the idle detecting means for actuating the first and second valve means when the engine is in the idle condition, the first valve means is open and the second valve means is closed to a predetermined extent.

The invention may be more fully understood from the description of the preferred embodiments of the invention set forth below, together with the accompanying drawings.

DESCRIPTION OF THE PREFERRED EMBODIMENTS

Figure 1:
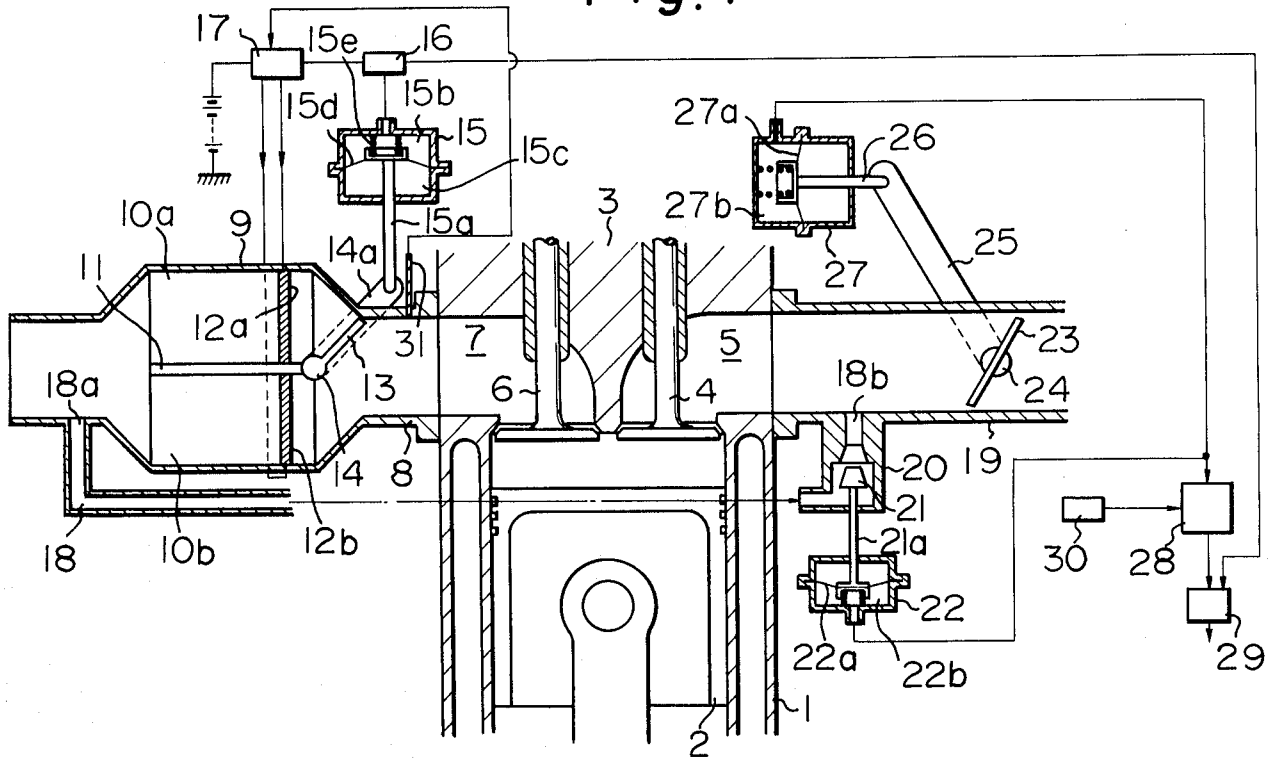
FIG. 1 is a diagrammatic section of an embodiment of an exhaust gas recirculating apparatus of a diesel engine according to the present invention.

In FIG. 1, one of the cylinders of a diesel engine is shown. In a cylinder block 1, there is provided a piston 2 which moves reciprocally therein. A cylinder head 3 is provided on the cylinder block 1. The numeral 4 indicates an intake valve which also moves upward and downward synchronized with the motion of the piston 2 to close or open an intake port 5. Similarly, an exhaust valve 6 and an exhaust port 7 are provided.

The exhaust ports 7 of all the cylinders are collectively connected to an exhaust manifold (not shown), as is well known. The exhaust manifold is connected to an exhaust pipe 8. The exhaust pipe 8 has a section 9, the diameter of which is greater than that of the remaining section. In this greater diameter section 9, a particulate trapper means is provided. The particulate trapper means comprises two filters 10*a* and 10*b* of ceramic material placed in parallel and separated by a plate 11. Heaters 12*a* and 12*b* are incorporated with filters 10*a* and 10*b*, respectively. Thus the filters 10*a* and 10 *b* and the plate 11 form two passages for the exhaust gas in this section 9. On the upstream side of the filters 10*a* and 10*b* in the exhaust pipe 9, a directional control valve 13 is pivotably provided on a shaft 14. The directional control valve 13 is adapted to close either one of the flow passages formed through the filters 10*a* and 10*b*. A lever 14*a* is rigidly connected to the shaft 14, which lever is linked to a vacuum diaphragm apparatus 15 through a rod 15*a*. The vacuum diaphragm apparatus 15 has a vacuum chamber 15*b* and an atmosphere pressure chamber 15*c* separated by a diaphragm 15*d*. The rod 15*a* is connected to the diaphragm 15*d* urged by a compression spring 15*e*. The vacuum chamber 15*b* of the vacuum diaphragm apparatus 15 is in fluid communication with an electromagnetic valve 16. The heaters 12*a* and 12*b* and the electromagnetic valve 16 are electrically connected to an electronic computer 17.

A bypass passage or an EGR pipe 18 has an inlet 18*a* which is open to the exhaust pipe 8 on the downstream side of the particulate trapper means or the filters 10*a* and 10*b* and an outlet 18*b* which is open to an intake pipe 19. A valve 20 is disposed in the EGR pipe 18, the valve body 21 of which is carried by a valve rod 21*a* which is connected to a diaphragm 22*a* of a vacuum diaphragm apparatus 22 similar to above-mentioned apparatus 15.

A throttle valve or a butterfly valve 23 is provided in the intake pipe 19 on the upstream side of the outlet 18*b* of the bypass passage 18. The throttle valve 23 is mounted on a shaft 24 which is connected to one end of a link 25, the other end of which is connected to a lever 26 which is connected to a diaphragm of a vacuum diaphragm apparatus 27. The respective vacuum chambers 22*b* and 27 *b* of the apparatuses 22 and 27 are in fluid communication with an electromagnetic valve 28 which is connected to a vacuum source or a vacuum pump 29. The electromagnetic valve 28 is electrically connected to an accelerator position detector 30 which is adapted to detect the engine idle condition and to produce a control signal for the electromagnetic valve 28. The engine idle condition may be detected by an accelerator switch only, a combination of the accelerator switch and an engine speed sensor, or any other similar means. The above-described electromagnetic valve 16 is also in fluid communication with the vacuum source 29. A back pressure sensor 31 is also provided in the exhaust pipe 8 for sensing the pressure in the exhaust passage on the upstream side of the filters 10*a* and 10*b*.

In operation, the exhaust gas passes through one of the passages provided by the filters 10*a* and 10*b* at the greater diameter area 9 of the exhaust pipe 8, the other passage being closed by the directional control valve 13. Most of the particulate matter included in the exhaust gas is caught by the filter 10*a* or 10*b*. The heater 12*a* or 12*b*, which is incorporated with the closed filter, is supplied with an electric current to heat the filter and burn the particulate matter deposited thereon. When the back pressure sensor 31 senses from the pressure rise that the open side filter is clogged with the particulate matter, its output is delivered to the electronic computer 17 which then delivers an electric signal to the electromagnetic valve 16 to open it. Thereby, the vacuum in the vacuum source 29 is introduced into the vacuum chamber 15*b* of the vacuum diaphragm apparatus 15, which in turn causes the diaphragm 15*d* to move upward in the drawing together with the rod 15*a*, which causes the open side valve to close through the lever 14*a*. This state is shown in FIG. 1, in which the filter 10*a* is closed. The heater 12*a* is supplied with electric current to burn the particulate matter deposited on the filter 10*a*. When the open side filter 10*b* is then clogged, the electromagnetic valve 16 is closed so that the atmospheric pressure is introduced into the vacuum chamber 15*b*, whereby the diaphragm 15*d* and rod 15*a* are moved downward by the effect of the compression spring 15*e*. This causes the valve 13 to close the filter 10*b*. It is to be understood that the exhaust gas including the particulate matter is substantially purified through this trapper means and reaches the inlet 18*a* of the bypass passage 18 with the particulate matter considerably removed. It is also to be understood that the exhaust gas is passed alternatively, through filters 10*a* and 10*b*, thereby maintaining the effect of purification over long-term use.

At engine start, the vacuum is not introduced into the vacuum chamber 27*b* of the vacuum diaphragm apparatus 27, therefore the throttle valve 23 is in the fully open position. This enables easy engine start as enough fresh air is supplied therethrough.

At the engine idle condition after warm-up, the electromagnetic valve 28 is opened by an electric signal from the accelerator switch 30. The vacuum in the vacuum source 29 is therefore introduced into both diaphragms 22*b* and 27*b* of the respective vacuum diaphragm apparatuses 22 and 27. The fresh air flow in the intake pipe 19 is throttled by rotation of the throttle valve 23 actuated by the vacuum diaphragm apparatus 27. Simultaneously, the vacuum diaphragm apparatus 22 actuates the valve 20 to open. A portion of the exhaust gas is recirculated into the intake pipe 19 through the EGR pipe 18. This recirculated exhaust gas, as previously described, has been substantially purified and the amount of particulate matter included in the recirculated gas has been considerably reduced.

Figure 2:
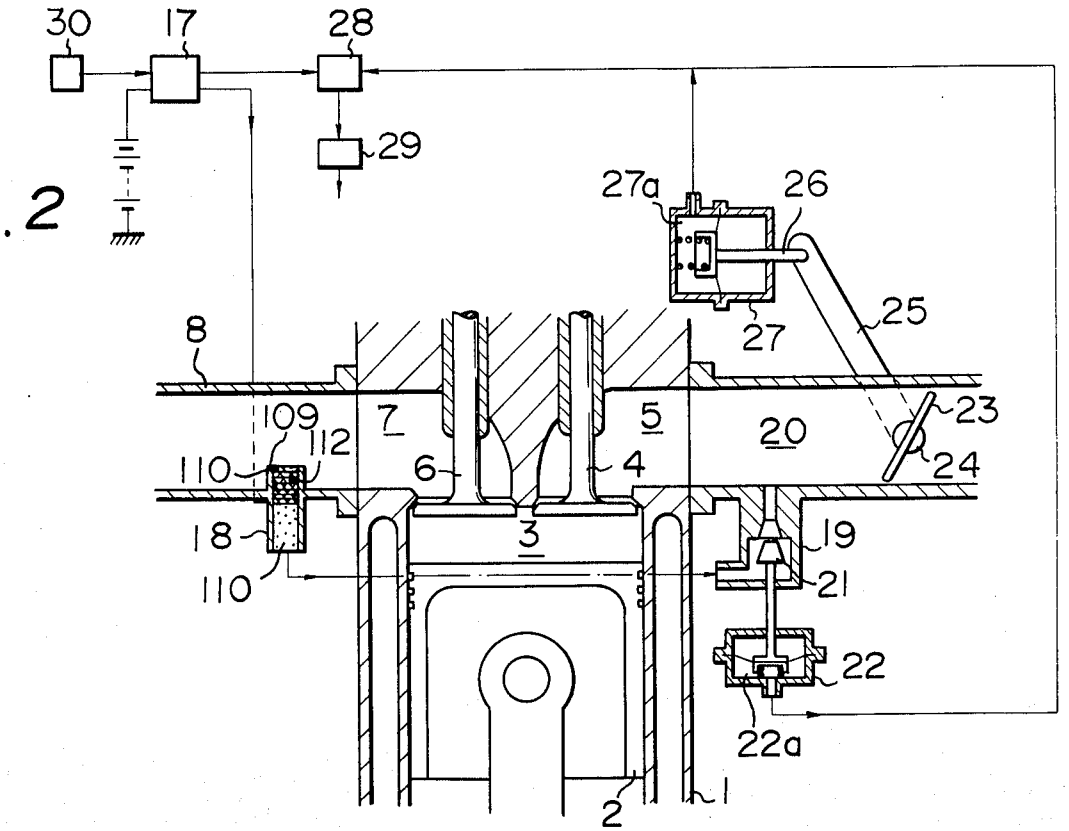
FIG. 2 is a similar section of another embodiment according to the present invention.

FIG. 2 shows another embodiment of the invention. Identical numerals represent identical parts as those of FIG. 1. In this embodiment, the particulate trapper means is provided in the bypass passage 18 at the inlet area 109 thereof. As shown, a filter 110 of ceramic material is inserted in the bypass passage 18. An electric heater 112 is incorporated with the filter 110. This embodiment enables a portion of the recirculated exhaust gas to be purified and the remainder to pass through the exhaust pipe 8 unpurified, as in conventional arrangements. The output of the accelerator position sensor 30 is input to the electronic computer 17 which outputs a control signal to the electromagnetic valve 28. The operation of this embodiment is similar to that of the first embodiment.

Figure 3:
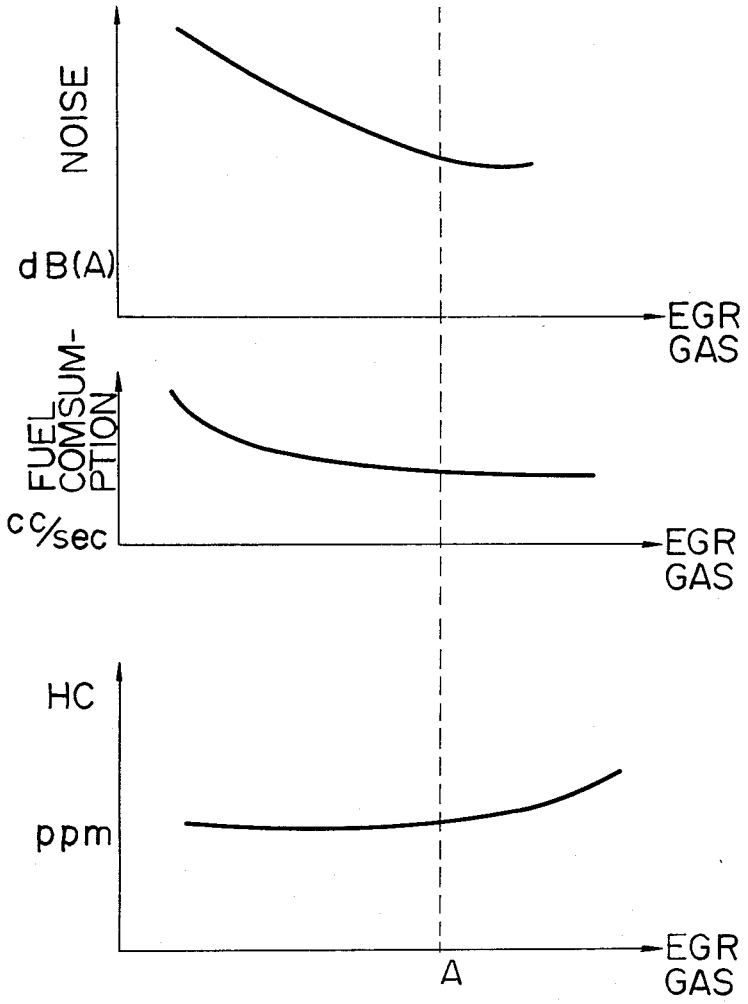
FIG. 3 is a graph of the noise level, fuel consumption, and hydrocarbon component relative to the amount of recirculated gas.

FIG. 3 shows a graph of the noise level, fuel consumption, and hydrocarbon component (vertical axis) with respect to the amount of recirculated gas (horizontal axis). As shown, the noise level and the fuel consumption decrease as the amount of EGR gas increases. The hydrocarbon component, first remains substantially constant, and only then gradually increases. The point where the curve of the hydrocarbon component changes is shown by the point A in FIG. 3. It is to be understood that the curve shown by the hydrocarbon component is obtained by providing the trapper means. The trapper means enables more exhaust gas to recirculate into engine since it considerably reduces the undesirable particulate matter. It is, therefore, apparent that the engine performance at the idle condition is improved, i.e., noise, fuel consumption, and pollution are lowered. The total flow entering the engine cylinders at the idle condition is controlled by determining the relative flows of the EGR gas and the fresh air to obtain optimum engine performance.

We claim:

1. An exhaust gas recirculating apparatus of a diesel engine having an intake air passage and an exhaust gas passage, said apparatus comprising:

a bypass passage having an inlet and an outlet to allow a portion of the exhaust gas to recirculate from the exhaust gas passage into the intake air passage;

a normally closed first valve means in the bypass passage;

a normally open second valve means in the intake passage on the upstream side of the outlet of the bypass passage;

a means for trapping the particulate matter included in the exhaust gas, said trapper means being located upstream of said first valve means, and so that the recirculating gas can pass through it;

heater means incorporated with said trapping means to burn the particulate matter trapped therein;

a means for detecting the idle condition of the engine; and an actuating means responsive to the output of the idle detecting means for actuating said first and said second valve means so that when the engine is in the idle condition said first valve means is open and said second valve means is closed to a predetermined extent.

2. An apparatus according to claim 1, wherein said particulate trapper means comprises a filter of ceramic material.

3. An apparatus according to claim 2, wherein said filter is disposed in the exhaust passage on the upstream side of the inlet of the bypass passage.

4. An apparatus according to claim 3, wherein the cross-sectional area of the section of the exhaust passage in which the filter is disposed is greater than that of the remaining section.

5. An apparatus according to claim 4, wherein there are two filters placed in parallel and separated from each other to form two passages therethrough and a third valve means is provided to alternatively close one of the passages formed by the filters.

6. An apparatus according to claim 2, wherein said filter is disposed in the bypass passage at the inlet thereof.

7. An apparatus according to claim 1, wherein said actuating means comprises two vacuum diaphragm apparatuses each having a vacuum chamber and an atmospheric pressure chamber separated by a diaphragm, said vacuum chamber being connected to a vacuum source through an electromagnetic valve, and said first and second valve means are operably connected to the respective vacuum diaphragm apparatuses.

8. An apparatus according to claim 7, wherein the electromagnetic valve is electrically connected to said idle detecting means for controlling the operation of the first and second valve means.

9. An exhaust gas recirculating apparatus of a diesel engine having an intake air passage and an exhaust gas passage, said apparatus comprising:

a bypass passage having an inlet and an outlet to allow a portion of the exhaust gas to recirculate from the exhaust gas passage into the intake air passage;

a normally closed first valve means in the bypass passage;

a normally open second valve means in the intake passage on the upstream side of the outlet of the bypass passage;

a means for trapping the particulate matter included in the exhaust gas comprising filter means of ceramic material disposed in said exhaust passage on the upstream side of said inlet of said bypass passage, said filter means comprising two filters arranged in parallel and separated from each other to form two passages therethrough;

third valve means in said exhaust passage upstream of said two passages to alternately close one of said two passages;

heater means incorporated with said trapping means to burn the particulate matter trapped therein;

a means for detecting the idle condition of the engine; and an actuating means responsive to the output of the idle detecting means for actuating said first and said second valve means so that when the engine is in the idle condition said first valve means is open and said second valve means is closed to a predetermined extent.

* * * * *